US007318415B2

(12) United States Patent
Fukasawa

(10) Patent No.: US 7,318,415 B2
(45) Date of Patent: Jan. 15, 2008

(54) CONTROLLER OF IN-CYLINDER INJECTION ENGINE

(75) Inventor: Osamu Fukasawa, Nagoya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/436,692

(22) Filed: May 19, 2006

(65) Prior Publication Data

US 2006/0266327 A1 Nov. 30, 2006

(30) Foreign Application Priority Data

May 24, 2005 (JP) ..... 2005-151317

(51) Int. Cl.
*F02D 41/04* (2006.01)
*F02D 41/38* (2006.01)

(52) U.S. Cl. ..... 123/458; 123/478

(58) Field of Classification Search ..... 123/457, 123/458, 478, 480; 701/104
See application file for complete search history.

(56) References Cited

U.S. PATENT DOCUMENTS 5,732,675 A 3/1998 Yoshida et al. ..... 123/305
6,298,830 B1 * 10/2001 Kono ..... 123/478
6,354,274 B1 * 3/2002 Shima et al. ..... 123/478
6,718,946 B2 * 4/2004 Hokazono et al. ..... 123/446

FOREIGN PATENT DOCUMENTS

| | | |
|---|---|---|
| JP | 09-195819 | 7/1997 |
| JP | 2000-320385 | * 11/2000 |
| JP | 2001-336436 | * 12/2001 |
| JP | 2003-322048 | 11/2003 |
| JP | 2004-346851 | * 12/2004 |

* cited by examiner

*Primary Examiner*—T. M Argenbright
(74) *Attorney, Agent, or Firm*—Nixon & Vanderhye P.C.

(57) ABSTRACT

If a high-pressure pump discharges fuel in an injection waiting period from injection setting to injection start, fuel pressure to occur at injection start time is estimated and a fuel pressure correction coefficient is calculated based on the estimated fuel pressure. If there is no fuel discharge in the injection waiting period, the fuel pressure sensed at the injection setting is regarded as the fuel pressure of the injection start time, and the fuel pressure correction coefficient is calculated based on the sensed fuel pressure. A final injection period is calculated by correcting a basic injection period with the fuel pressure correction coefficient. Thus, fuel pressure correction of the injection period is performed accurately even if actual fuel pressure fluctuates due to the fuel discharge from the high-pressure pump during the injection waiting period.

12 Claims, 11 Drawing Sheets

CONTROLLER OF IN-CYLINDER INJECTION ENGINE

CROSS REFERENCE TO RELATED APPLICATION

This application is based on and incorporates herein by reference Japanese Patent Application No. 2005-151317 filed on May 24, 2005.

BACKGROUND OF THE INVENTION

1. Field of the Invention

The present invention relates to a controller of an in-cylinder injection engine that pressurizes fuel to high pressure and supplies the high-pressure fuel to a fuel injection valve with a high-pressure pump, the fuel injection valve injecting the fuel directly into a cylinder.

2. Description of Related Art

An in-cylinder injection engine that injects fuel directly into a cylinder has a shorter period from injection to combustion than an intake port injection engine that injects the fuel in an intake port. Accordingly, the in-cylinder injection engine cannot have a sufficient period to atomize the injected fuel. The in-cylinder injection engine has to atomize the injected fuel by increasing injection pressure to high pressure. A certain in-cylinder injection engine pressurizes fuel, which is drawn by a low-pressure pump from a fuel tank, to high pressure with a high-pressure pump driven by a camshaft of the engine and pressure-feeds the fuel to a fuel injection valve with the high-pressure pump, for example, as described in JP-A-2003-322048. The in-cylinder injection engine senses pressure (fuel pressure) of the fuel supplied to the fuel injection valve with a fuel pressure sensor and feedback-controls a discharge amount of the high-pressure pump (valve closing time of a fuel pressure control valve) to conform the sensed fuel pressure to target fuel pressure.

In the in-cylinder injection engine, an injection amount of the fuel injection valve is controlled with an injection period (injection pulse width) as in the intake port injection engine. Even if the injection period is the same, the actual injection amount varies when the fuel pressure changes. Therefore, a fuel pressure correction coefficient is set in accordance with the fuel pressure sensed by the fuel pressure sensor, and a basic injection period calculated in accordance with an operating state of the engine is corrected with the fuel pressure correction coefficient. Thus, the injection period is set in consideration of the change in the fuel pressure.

In order to absorb the variation in the injection amount due to a tolerance or a temporal change of the fuel injection valve and the like, a fuel pressure correction technology described in JP-A-H09-209804 integrates a fuel pressure change sensed by a fuel pressure sensor and performs fuel pressure correction of an injection period with the integration value of the fuel pressure change.

A fuel pressure correction technology described in JP-A-H09-195819 corrects injection start timing based on a difference between fuel pressure sensed by a fuel pressure sensor and target fuel pressure.

There is an injection waiting period from injection setting time, at which an injection period or injection start timing is set, to injection start time. If the high-pressure pump discharges the fuel during the injection waiting period, the actual fuel pressure can increase, so that the actual fuel pressure to occur at the injection start time becomes higher than the pressure at the injection setting time.

Even if the fuel pressure correction of the injection period or the injection start timing is performed with the fuel pressure and the like sensed by the fuel pressure sensor at the injection setting time (or before) as in JP-A-2003-322048 or JP-A-H09-209804, there is a possibility that the actual fuel pressure at the injection start time fluctuates from the actual fuel pressure at the injection setting time (injection period calculation time), deteriorating accuracy of the fuel pressure correction. Specifically, the fuel pressure fluctuation due to the fuel discharge of the high-pressure pump increases more when the engine is started or when the target fuel pressure changes than when the engine is in a steady operation. Accordingly, the fuel pressure correction accuracy deteriorates more.

SUMMARY OF THE INVENTION

It is an object of the present invention to provide a controller of an in-cylinder injection internal combustion engine capable of accurately performing fuel pressure correction of an injection period (injection amount) even if actual fuel pressure fluctuates due to fuel discharge of a high-pressure pump in an injection waiting period from injection period calculation time (injection setting time) to injection start time.

According to an aspect of the present invention, a controller for an in-cylinder injection internal combustion engine has a fuel pressure sensor, a fuel pressure controlling device, a fuel pressure correcting device, an injection setting device and an injection controlling device. The fuel pressure sensor senses pressure of fuel supplied to a fuel injection valve. The fuel pressure controlling device controls a discharge amount of a high-pressure pump to conform the fuel pressure sensed by the fuel pressure sensor to target fuel pressure. The fuel pressure correcting device calculates a final injection period by correcting a basic fuel injection period, which corresponds to an operating condition of the engine, with a fuel pressure correction coefficient, which corresponds to the fuel pressure, at predetermined timing before an injection start. The injection setting device sets injection start timing and the injection period at the predetermined timing before the injection start. The injection controlling device performs injection by driving the fuel injection valve at the injection start timing for the injection period set by the injection setting device. The fuel pressure correcting device performs estimated fuel pressure correction for estimating the fuel pressure of the injection start time and for setting the fuel pressure correction coefficient based on the estimated fuel pressure.

Thus, when the fuel pressure correction of the injection period (injection amount) is performed, the estimated fuel pressure correction for estimating the fuel pressure of the injection start time and for setting the fuel pressure correction coefficient based on the estimated fuel pressure is performed. Accordingly, even if the actual fuel pressure fluctuates before the injection start time due to the fuel discharge of the high-pressure pump, the fuel pressure correction coefficient can be set in consideration of the fluctuation of the actual fuel pressure. As a result, the fuel pressure correction of the injection period (injection amount) can be performed accurately.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
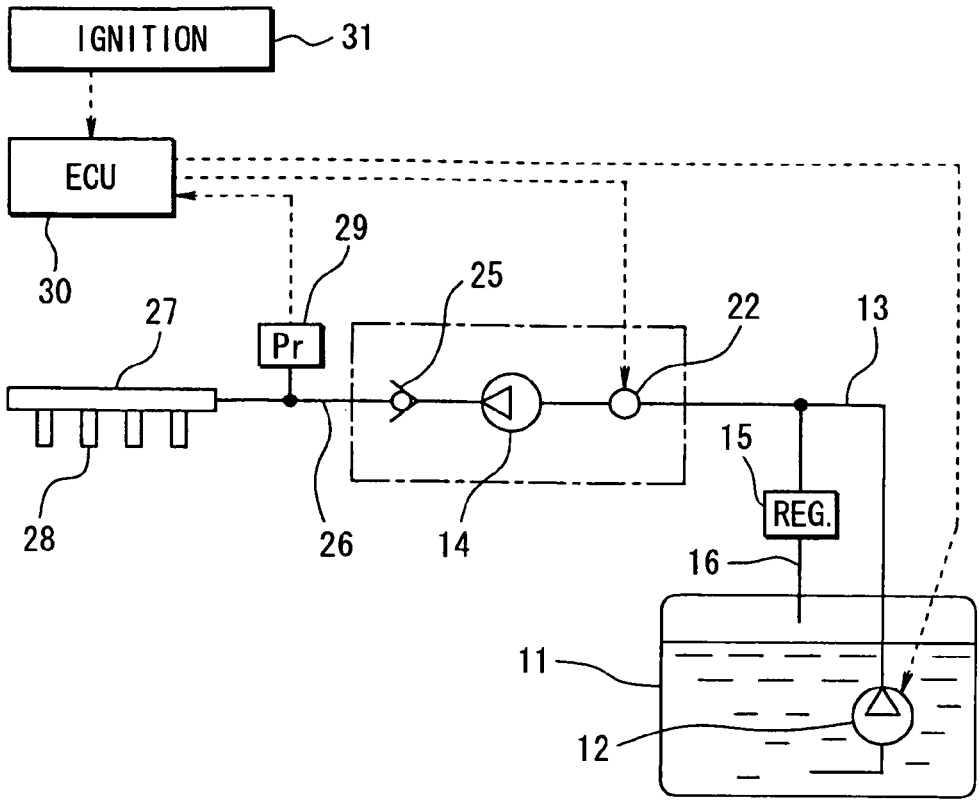
FIG. 1 is a schematic diagram showing a fuel injection system according to a first example embodiment of the present invention.

Referring to FIG. 1, a fuel supply system of an in-cylinder injection engine according to a first example embodiment of the present invention is illustrated. A low-pressure pump 12 for drawing fuel is placed in a fuel tank 11 that stores the fuel. The low-pressure pump 12 is driven by an electric motor (not shown) that uses a battery (not shown) as a power source. The fuel discharged from the low-pressure pump 12 is supplied to a high-pressure pump 14 through a fuel pipe 13. A pressure regulator 15 is connected to the fuel pipe 13. The pressure regulator 15 regulates a discharge pressure of the low-pressure pump 12 (fuel supply pressure to the high-pressure pump 14) to a predetermined pressure. Excessive fuel generating pressure over the predetermined pressure is returned into the fuel tank 11 through a fuel return pipe 16.

Figure 2:
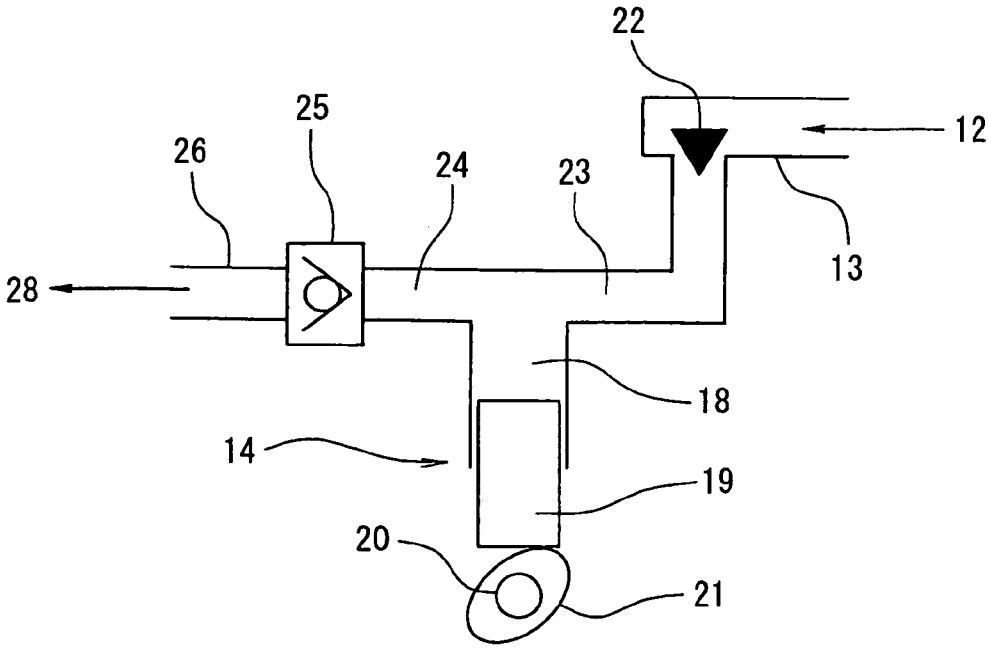
FIG. 2 is a schematic diagram showing a high-pressure pump according to the FIG. 1 embodiment.

As shown in FIG. 2, the high-pressure pump 14 is a piston pump that reciprocates a piston 19 in a cylindrical pump chamber 18 to suction/discharge the fuel. The piston 19 is driven by rotational movement of a cam 21 fit to a camshaft 20 of the engine. A fuel pressure control valve 22 consisting of a normally opened electromagnetic valve is located on a suction hole 23 side of the high-pressure pump 14. In a suction stroke of the high-pressure pump 14 (stroke in which the piston 19 descends), the fuel pressure control valve 22 is opened and the fuel is suctioned into the pump chamber 18. In a discharge stroke (stroke in which the piston 19 ascends), a valve closing period of the fuel pressure control valve 22 (period of a valve closed state from valve closing start timing to top dead center of the piston 19) of the fuel pressure control valve 22 is controlled. Thus, the discharge amount of the high-pressure pump 14 is controlled to control the fuel pressure (discharge pressure).

Figure 3:
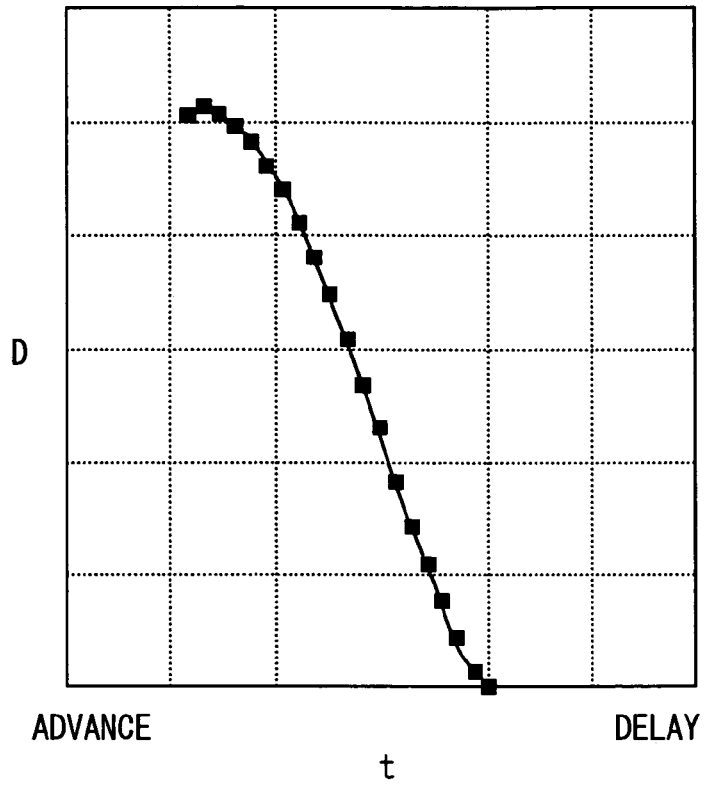
FIG. 3 is a graph showing a map for calculating a fuel discharge amount of the high-pressure pump according to the FIG. 1 embodiment.

When the fuel pressure is to be increased, the valve closing start timing (energization timing t) of the fuel pressure control valve 22 is advanced to lengthen the valve closing period of the fuel pressure control valve 22 and to increase the discharge amount D of the high-pressure pump 14 as shown in FIG. 3. When the fuel pressure is to be decreased, the valve closing start timing (energization timing t) of the fuel pressure control valve 22 is delayed to shorten the valve closing period of the fuel pressure control valve 22 and to decrease the discharge amount D of the high-pressure pump 14.

A check valve 25 for preventing a backflow of the discharged fuel is placed on a discharge hole 24 side of the high-pressure pump 14. The fuel discharged from the high-pressure pump 14 is delivered to a delivery pipe 27 through a high-pressure fuel pipe 26. The high-pressure fuel is distributed from the deliver pipe 27 to fuel injection valves 28 attached to a cylinder head of the engine for respective cylinders. A fuel pressure sensor 29 for sensing the fuel pressure is provided in the high-pressure fuel pipe 26. An output signal of the fuel pressure sensor 29 is input to an engine control circuit (engine control unit: ECU) 30.

The ECU 30 consists mainly of a microcomputer. The ECU 30 feedback-controls the discharge amount of the high-pressure pump 14 (energization timing of the fuel pressure control valve 22) to conform the fuel pressure sensed by the fuel pressure sensor 29 to target fuel pressure. The ECU 30 reads in output signals of various sensors sensing engine operation states such as engine rotation speed, intake pipe pressure (or intake amount) and cooling water temperature and calculates a basic injection period (basic injection amount) and injection start timing in accordance with the engine operation states. The ECU 30 executes routines (explained later) to perform estimated fuel pressure correction for setting a fuel pressure correction coefficient based on estimated fuel pressure of the injection start time and for calculating a final injection period by correcting the basic injection period with the fuel pressure correction coefficient.

The ECU 30 sets the injection start timing and the injection period at time earlier than the injection start by a predetermined period (predetermined crank angle). The ECU 30 executes the fuel injection by driving the fuel injection valve 28 at the injection start timing for the injection period.

Figure 10:
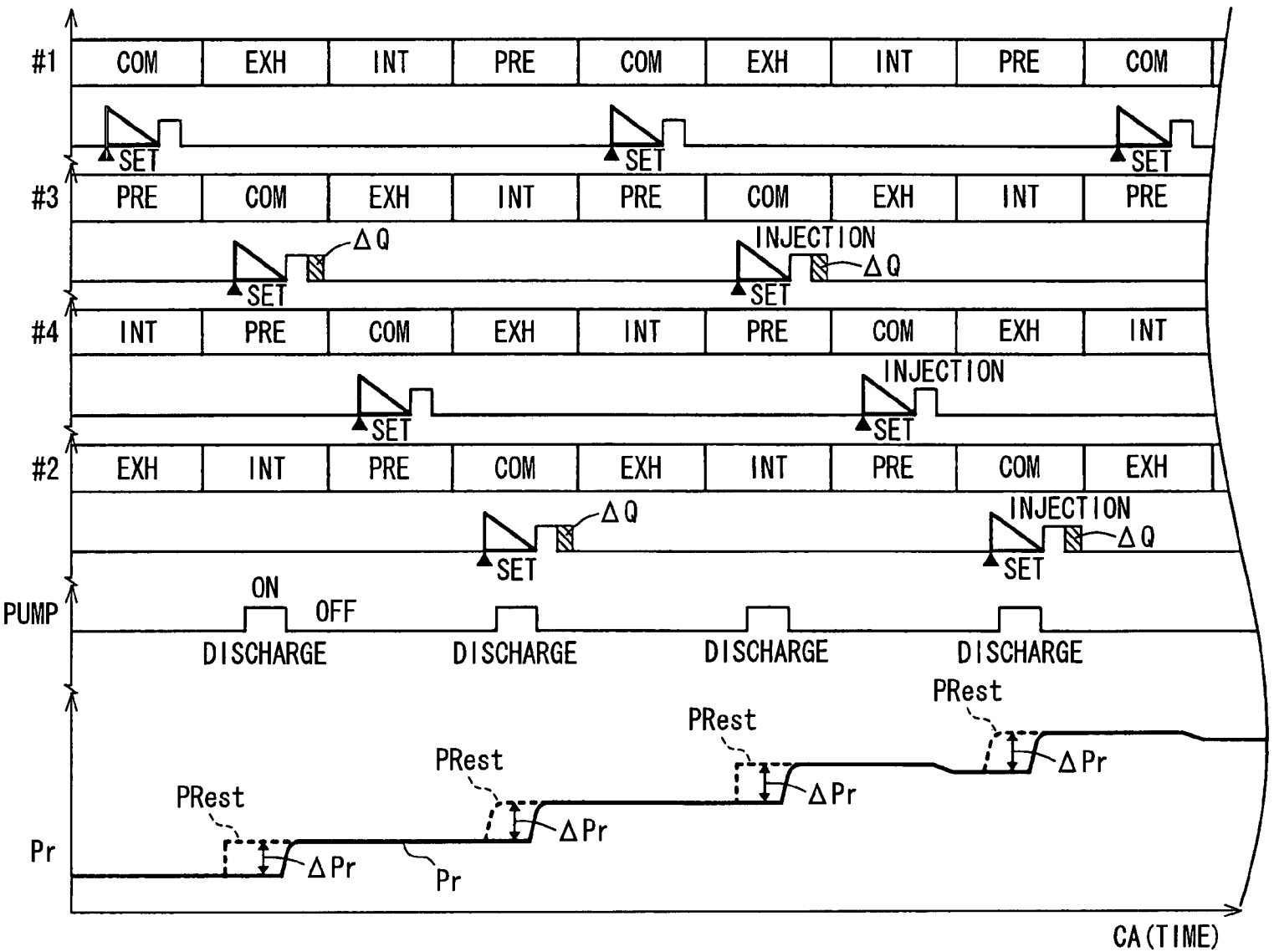
FIG. 10 is a time chart showing an example of estimated fuel pressure correction at the start-up according to the FIG. 1 embodiment.
Figure 11:
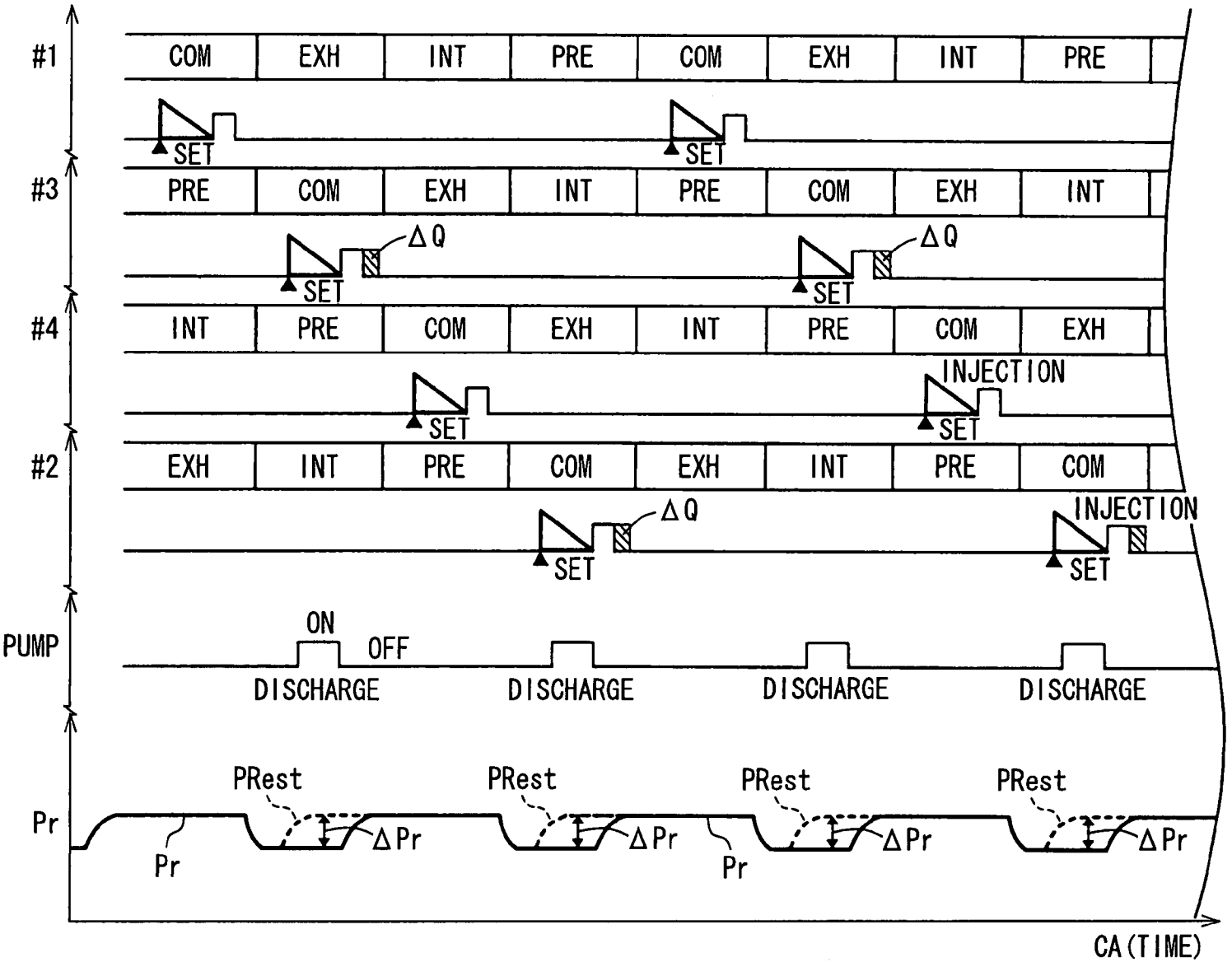
FIG. 11 is a time chart showing an example of the estimated fuel pressure correction after the start-up according to the FIG. 1 embodiment.

Next, the estimated fuel pressure correction of the present embodiment will be explained based on time charts shown in FIGS. 10 to 12. FIG. 10 shows an example of the estimated fuel pressure correction at a start-up. FIG. 11 shows an example of the estimated fuel pressure correction after the start-up.

At an initialization time (initialization processing time) immediately after an ignition switch (IG switch) 31 is turned on, an output of the fuel pressure senor 29 is read in to sense initial fuel pressure (base fuel pressure) PO provided before the discharge of the high-pressure pump 14. The output of the fuel pressure sensor 29 is read in to sense the fuel pressure Pr provided after the initial discharge stroke of the high-pressure pump 14 when the initial discharge stroke of the high-pressure pump 14 ends after cranking is started. The initial fuel pressure P0 is subtracted from the fuel pressure Pr to calculate a fuel pressure difference (Pr−P0) across the initial discharge stroke of the high-pressure pump 14.

At the injection setting time (designated as SET in FIGS. 10 to 12) of each cylinder, i.e., at the time for calculating the injection period, the output signals of the various sensors for sensing the engine operation states such as the engine rotation speed, the intake pipe pressure (or intake amount), or the cooling water temperature are input and the basic injection period (basic injection amount) and the injection start timing corresponding to the engine operation states are calculated. At the same time, the basic injection period (basic injection amount) is corrected with a fuel pressure correction coefficient KP corresponding to the fuel pressure to calculate the final injection period. The injection period and the injection start timing are set. In FIGS. 10 and 11, signs #1, #2, #3 and #4 represent the cylinders of the engine. Signs INT, PRE, COM and EXH represent an intake stroke, a compression stroke, a combustion stroke and an exhaustion stroke of each cylinder. PUMP in FIGS. 10 to 12 represents a high-pressure pump signal (energization flag).

If there is no fuel discharge from the high-pressure pump 14 in the injection waiting period from the injection setting to the injection start, the actual fuel pressure at the injection setting time substantially conforms to the actual fuel pressure to occur at the injection start time. If there is a fuel discharge from the high-pressure pump 14 in the injection waiting period, the actual fuel pressure increases due to the fuel discharge from the high-pressure pump 14, so that the actual fuel pressure of the injection start time becomes higher than the actual fuel pressure of the injection setting time.

Figure 12:
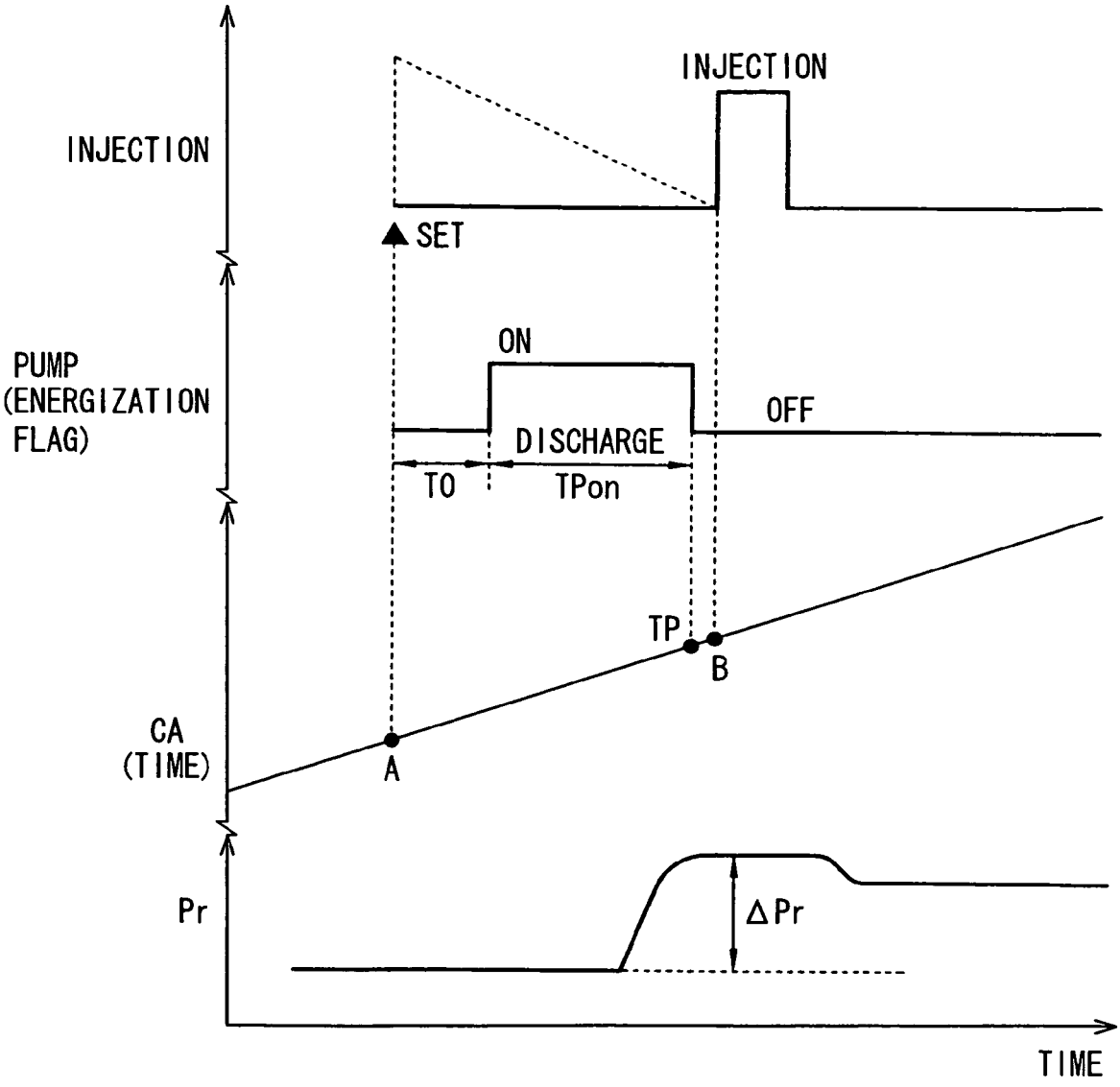
FIG. 12 is a time chart showing a control example according to the FIG. 1 embodiment.

Therefore, as shown in FIG. 12, it is determined whether the fuel discharge at a crank angle (CA, time) TP from the high-pressure pump 14 exists in the injection waiting period from the injection setting at time A to the injection start at time B. If the fuel discharge (time TP) exists in the injection waiting period, the fuel pressure PRset of the injection start time is estimated, and the fuel pressure correction coefficient KP is calculated based on the estimated fuel pressure PRest.

When the fuel pressure PRest of the injection start time is estimated, a fuel pressure increase ΔPr from the injection setting to the injection start is estimated by either one of following methods (1) to (3), first.

(1) The fuel pressure increase ΔPr from the injection setting to the injection start is estimated based on the fuel pressure difference (Pr−PO) across the initial discharge stroke of the high-pressure pump 14. For example, the fuel pressure difference (Pr−PO) across the initial discharge stroke of the high-pressure pump 14 itself is used as the estimate of the fuel pressure increase ΔPr from the injection setting to the injection start. The method of estimating the fuel pressure increase ΔPr by using the fuel pressure difference (Pr−PO) across the initial discharge stroke is suitable for estimating the fuel pressure increase ΔPr at the time such as a start-up in which the fluctuation in the actual fuel pressure is large. The fuel pressure increase ΔPr from the injection setting to the injection start may be estimated based on a fuel pressure difference across the second or following discharge stroke. The fuel pressure increase may be estimated by correcting the fuel pressure difference across the discharge stroke of the high-pressure pump 14 in accordance with the sensed fuel pressure Pr and/or fuel temperature at the moment.

(2) The discharge amount from the high-pressure pump 14 in the injection waiting period from the injection setting to the injection start is calculated based on a difference between target fuel pressure Ptgt and the sensed fuel pressure Pr or the valve closing time (energization timing) of the fuel pressure control valve 22, for example. Then, the fuel pressure increase ΔPr is calculated from the discharge amount.

Figure 13:
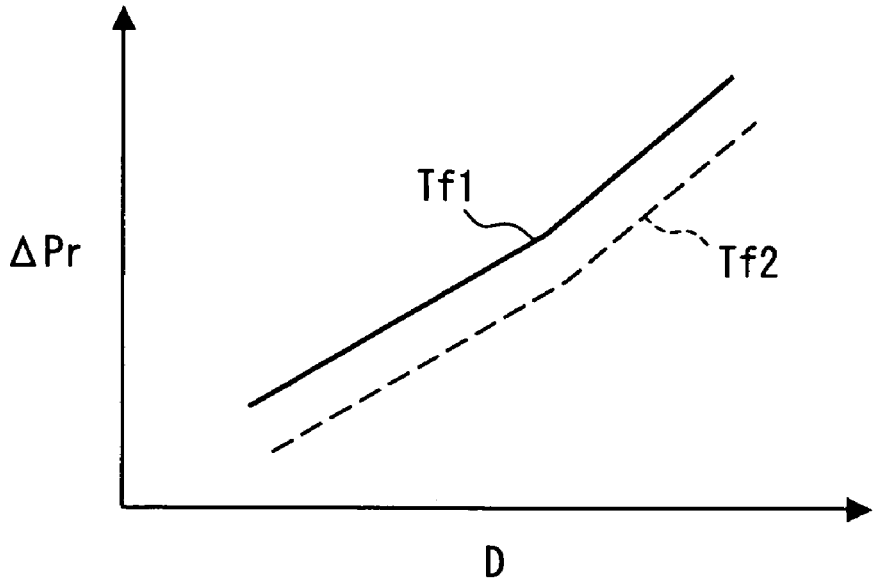
FIG. 13 is a diagram showing a map for calculating a fuel pressure increase according to the FIG. 1 embodiment.
Figure 14:
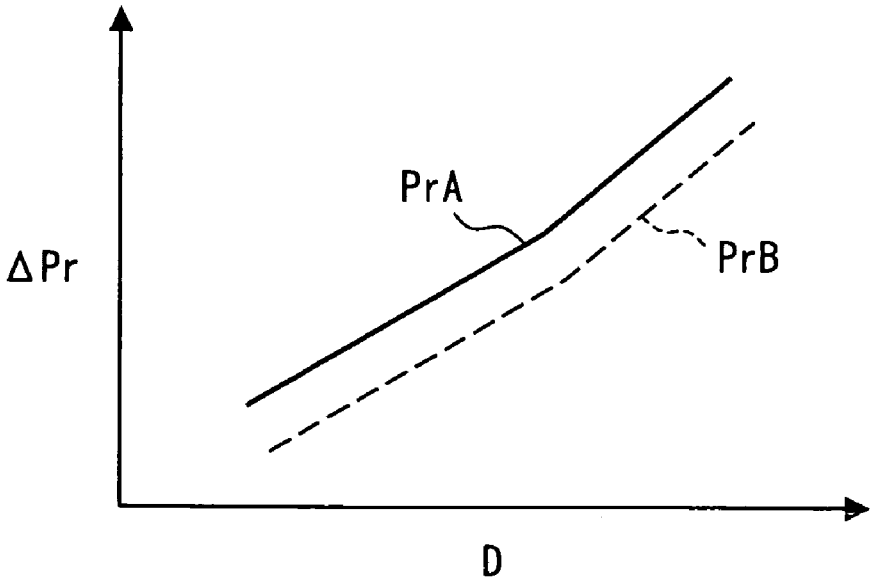
FIG. 14 is a diagram showing a map for calculating the fuel pressure increase according to the FIG. 1 embodiment.

Generally, as the fuel temperature Tf at the injection setting time increases, the fuel pressure increase ΔPr tends to increase due to thermal expansion of the fuel and the like. As the fuel pressure Pr at the injection setting time increases, the fuel pressure increase ΔPr tends to decrease. In consideration of these characteristics, the fuel temperature Tf at the injection setting time may be sensed with a sensor or estimated, and the fuel pressure increase ΔPr may be calculated in accordance with the discharge amount D of the high-pressure pump 14 and the fuel temperature Tf in the injection waiting period based on a map shown in FIG. 13. Characteristics Tf1 and Tf2 shown in FIG. 13 respectively correspond to fuel temperature Tf1 and fuel temperature Tf2, which is lower than the fuel temperature Tf1. Alternatively, the fuel pressure increase ΔPr may be calculated in accordance with the discharge amount D of the high-pressure pump 14 in the injection waiting period and the sensed fuel pressure Pr of the injection setting time based on a map shown in FIG. 14 and the like. Characteristics PrA and PrB shown in FIG. 14 respectively correspond to fuel pressure PrA and fuel pressure PrB, which is lower than the fuel pressure PrA. The fuel pressure increase ΔPr may be calculated by correcting a fuel pressure increase, which is calculated only from the discharge amount D of the high-pressure pump 14, with a correction coefficient corresponding to the fuel temperature Tf or the sensed fuel pressure Pr. Alternatively, the fuel pressure increase ΔPr may be calculated in accordance with the discharge amount D of the high-pressure pump 14, the fuel temperature Tf and the sensed fuel pressure Pr of the injection setting time based on a three-dimension map and the like.

Further, the fuel pressure increase ΔPr corresponding to the fuel temperature Tf of the injection setting time may be calculated with a map and the like, or the fuel pressure increase ΔPr corresponding to the sensed fuel pressure Pr of the injection setting time may be calculated with a map and the like. The fuel pressure increase ΔPr corresponding to the fuel temperature Tf and the sensed fuel pressure Pr of the injection setting time may be calculated with a two-dimensional map and the like.

(3) The fuel discharge performance of the high-pressure pump 14 varies due to a manufacture tolerance, a temporal change and the like. Even if the energization timing of the high-pressure pump 14 (valve closing time of the fuel pressure control valve 22) is the same, the fuel pressure increase ΔPr varies due to the variation of the fuel discharge performance of the high-pressure pump 14. Therefore, an actual measurement value (value sensed by the fuel pressure sensor 29) of the fuel pressure increase ΔPr from the injection setting to the injection start may be renewed and stored as a learning value for each start-up in a rewritable non-volatile memory such as backup RAM of the ECU 30. The learning value of the fuel pressure increase ΔPr stored in the non-volatile memory may be used in the actual start-up. In this case, in order to improve the learning accuracy of the fuel pressure increase ΔPr, multiple learning areas may be defined in accordance with conditions such as fuel temperature or fuel pressure and the fuel pressure increase ΔPr may be learned for each learning area. The fuel pressure increase ΔPr may be learned independently of the fuel temperature or the fuel pressure.

After the fuel pressure increase ΔPr before the injection start is calculated through either one of the above-described methods, the fuel pressure increase ΔPr is added to the sensed fuel pressure Pr of the injection setting time to calculate the estimated fuel pressure PRest of the injection start time (PRest=Pr+ΔPr).

If the difference between the target fuel pressure Ptgt and the sensed fuel pressure Pr is a fuel pressure difference that can be achieved by the fuel discharge from the high-pressure pump 14 by the injection start, i.e., if the difference is equal to or lower than the maximum achievable fuel pressure increase, the target fuel pressure Ptgt itself is estimated as the fuel pressure PRest of the injection start time. The maximum fuel pressure increase that can be achieved by the fuel discharge from the high-pressure pump 14 in the injection waiting period before the injection start can be determined based on the fuel discharge performance of the high-pressure pump 14 in advance. Therefore, if the difference between the target fuel pressure Ptgt and the sensed fuel pressure Pr is a fuel pressure difference that can be achieved during the injection waiting period, i.e., if the difference is equal to or lower than the maximum achievable fuel pressure increase, it is clear that the actual fuel pressure increases to the target fuel pressure Ptgt by the injection start. Therefore, the target fuel pressure Ptgt itself is estimated as the fuel pressure PRest of the injection start time.

If there is no fuel discharge from the high-pressure pump 14 during the injection waiting period from the injection setting to the injection start, the actual fuel pressure of the injection setting time substantially coincides with the actual fuel pressure of the injection start time. Therefore, the sensed fuel pressure Pr of the injection setting time itself is regarded as the fuel pressure of the injection start time, and the fuel pressure correction coefficient KP is calculated based on the sensed fuel pressure Pr.

The ECU 30 executes the above-explained estimated fuel pressure correction based on routines shown in FIGS. 4, 5, 8 and 9. Next, processing contents of the respective routines will be explained.

Figure 4:
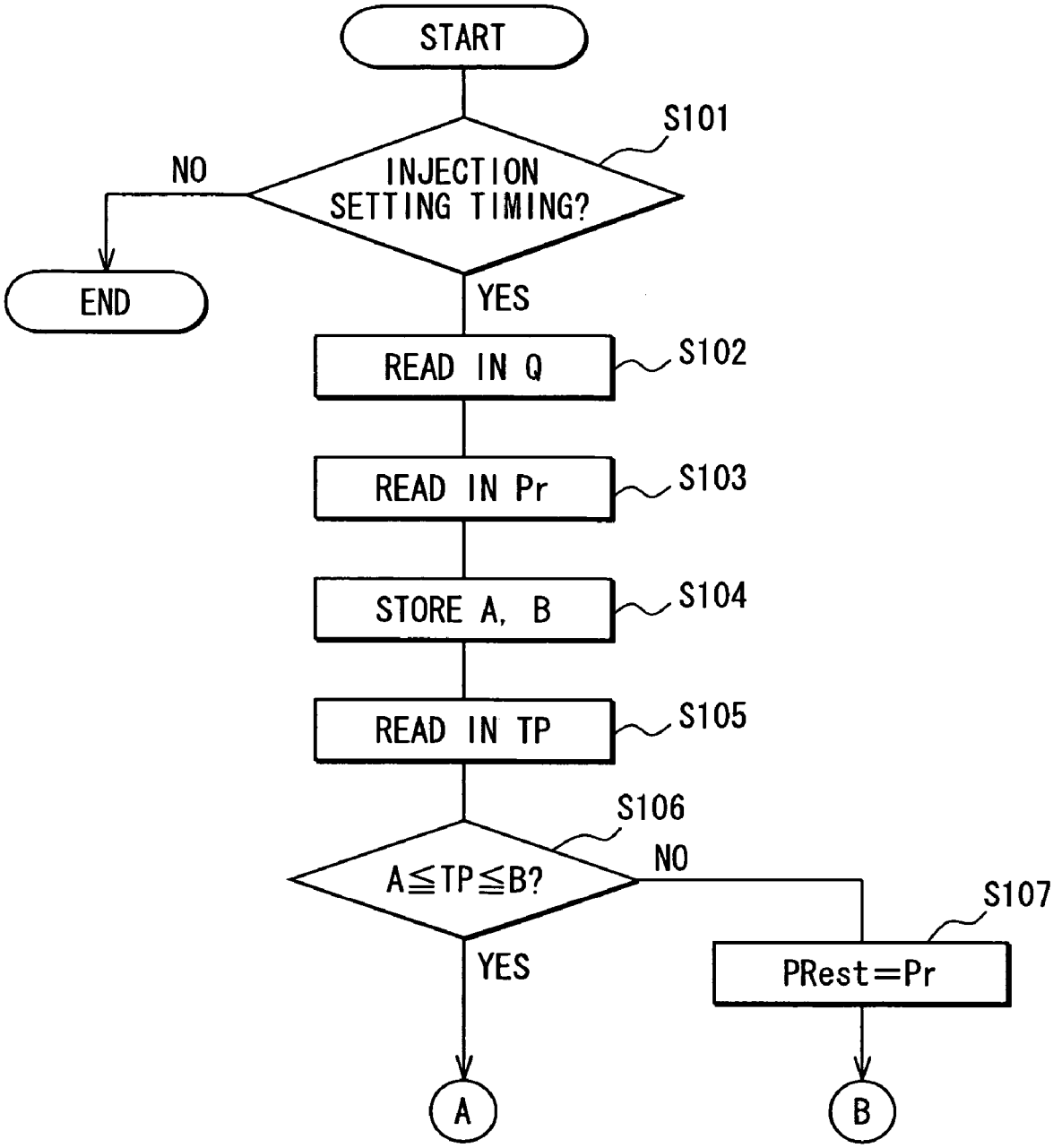
FIG. 4 is a flowchart showing an injection period calculation routine according to the FIG. 1 embodiment.
Figure 5:
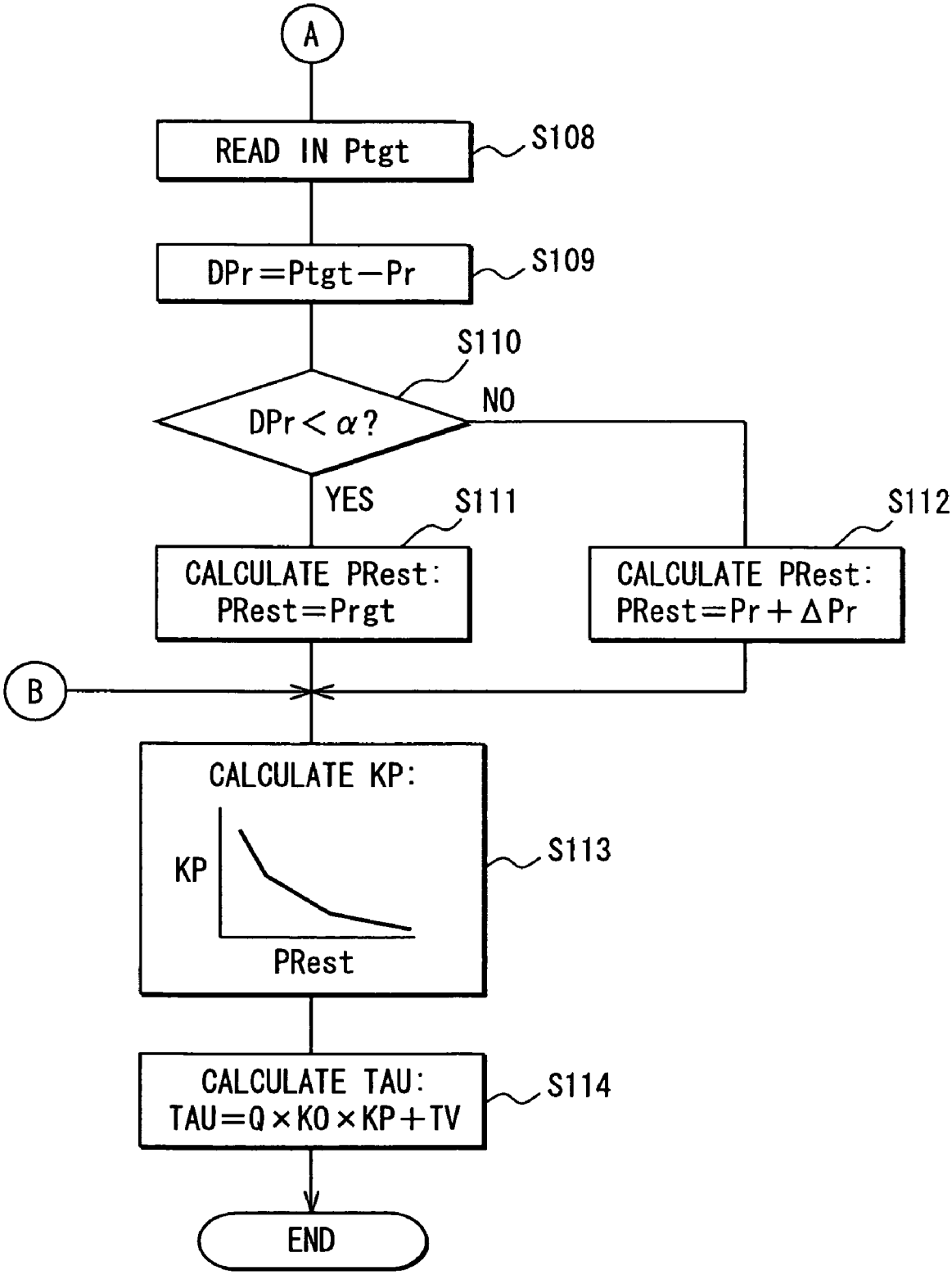
FIG. 5 is a flowchart showing the injection period calculation routine according to the FIG. 1 embodiment.

An injection period calculation routine shown in FIGS. 4 and 5 is started in a predetermined cycle (for example, cycle of 8 ms) while the ignition switch 31 is ON. If this routine is started, first, Step S101 determines whether it is the injection setting timing. If Step S101 is NO, the routine is ended without executing following process.

Thereafter, when the injection setting timing is reached, the process proceeds from Step S101 to Step S102. Step S102 reads in a basic injection amount Q calculated based on an engine operation state. Then, Step S103 reads in the present fuel pressure Pr (at the injection setting time) sensed by the fuel pressure sensor 29. Then, the process goes to Step S104, where a present crank angle A (injection setting time) and a crank angle B at the injection start time are stored in the memory such as RAM of the ECU 30.

Then, Step S105 reads in a crank angle TP of the end of the energization of the high-pressure pump 14 (energization end time). Then, Step S106 determines whether the crank angle TP (energization end time of the high-pressure pump 14) is in a period from the present crank angle A (injection setting time) to the crank angle B (injection start time), i.e., whether A≦TP≦B. Thus, it is determined whether the fuel discharge (point TP) from the high-pressure pump 14 occurs in the period from the injection setting (point A) to the injection start (point B).

If Step S106 is NO, i.e., if it is determined that the fuel discharge from the high-pressure pump 14 (point TP) is out of the period from the injection setting (point A) to the injection start (point B), it is determined that the fuel pressure Pr does not fluctuation in the period from the injection setting (point A) to the injection start (point B). In this case, the sensed fuel pressure Pr of the injection setting time itself is set as the estimated fuel pressure PRest of the injection start time at Step S107.

Figure 6:
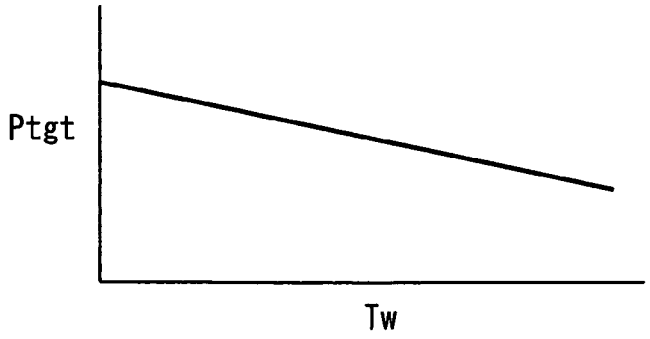
FIG. 6 is a graph showing a map for calculating target fuel pressure at a start-up according to the FIG. 1 embodiment.
Figure 7:
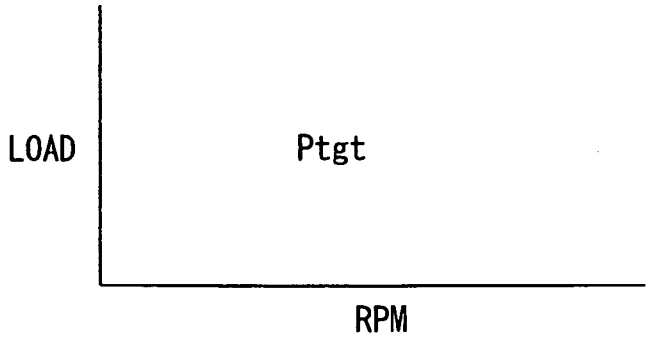
FIG. 7 is a graph showing a map for calculating the target fuel pressure after the start-up according to the FIG. 1 embodiment.

If Step S106 is YES, i.e., if it is determined that the fuel discharge from the high-pressure pump 14 (point TP) occurs in the period from the injection setting (point A) to the injection start (point B), the process goes to Step S108 shown in FIG. 5, where the target fuel pressure Ptgt at the moment (injection setting time) is read in. The target fuel pressure Ptgt is set higher as the cooling water temperature Tw decreases as shown in FIG. 6 at the start-up. After the start-up, the target fuel pressure Ptgt is set in accordance with the engine operation states such as the engine rotation speed RPM or a load as shown in FIG. 7.

Thereafter, the process goes to Step S109, where a difference DPr at the moment (injection setting time) between the target fuel pressure Ptgt and the sensed fuel pressure Pr is calculated (DPr=Ptgt−Pr).

Then, Step S110 determines whether the difference DPr at the moment (injection setting time) is less than a predetermined determination value α. Thus, Step S110 determines whether the difference DPr between the target fuel pressure Ptgt and the sensed fuel pressure Pr is a fuel pressure difference that can be achieved by the fuel discharge from the high-pressure pump 14 by the injection start, i.e., whether the difference is equal to or lower than the maximum achievable fuel pressure increase. The determination value α is set at the maximum fuel pressure increase, which can be achieved by the fuel discharge from the high-pressure pump 14 before the injection start, or somewhat lower. The determination value α may be a fixed value for the sake of simple computation processing. Alternatively, the determination value α may be set in accordance with the fuel temperature or the sensed fuel pressure Pr based on a map and the like in consideration of a change of the fuel pressure increase ΔPr due to the fuel temperature or the fuel pressure.

If Step S110 is YES, it is determined that the difference DPr between the target fuel pressure Ptgt and the sensed fuel pressure Pr is a fuel pressure difference that can be achieved by the fuel discharge from the high-pressure pump 14 by the injection start and the process goes to Step S111. Step S111 sets the target fuel pressure Ptgt at the moment (injection setting time) itself as the estimated fuel pressure PRest of the injection start time.

If Step S110 is NO, the process goes to Step S112. Step S112 adds the fuel pressure increase ΔPr from the injection setting to the injection start to the sensed fuel pressure Pr at the moment (injection setting time) to calculate the estimated fuel pressure PRest of the injection start time. The fuel pressure increase ΔPr is calculated by a fuel pressure increase calculation routine shown in FIG. 8.

After the estimated fuel pressure PRest of the injection start time is calculated, the process goes to Step S113. Step S113 calculates the fuel pressure correction coefficient KP corresponding to the estimated fuel pressure PRest of the injection start time in reference to a fuel pressure correction coefficient calculation map using the estimated fuel pressure PRest of the injection start time as a parameter. Thereafter, the process goes to Step S114, where a final injection period TAU is calculated by correcting the basic injection amount Q with the fuel pressure correction coefficient KP based on a following equation (1).

$$TAU=Q\times KO\times KP+TV \quad (1)$$

In the equation (1), KO represents a conversion coefficient for converting the injection amount into the injection period and TV is an invalid injection period.

Figure 8:
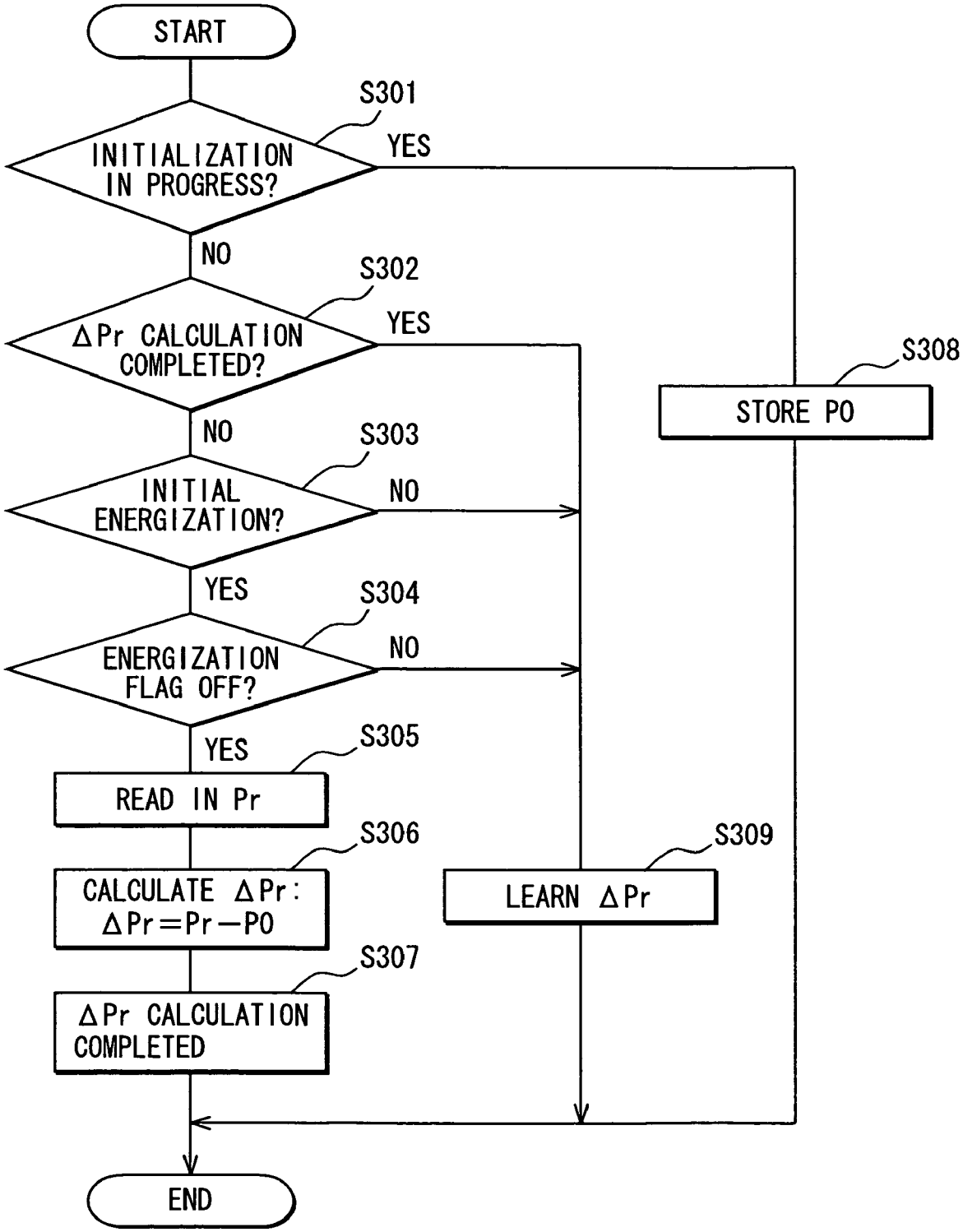
FIG. 8 is a flowchart showing a fuel pressure increase calculation routine according to the FIG. 1 embodiment.

The fuel pressure increase calculation routine shown in FIG. 8 is executed before the injection period calculation routine shown in FIGS. 4 and 5 is executed for each injection setting. If the routine shown in FIG. 8 is started, first, Step S301 determines whether initialization (initialization processing) immediately after the turning on of the ignition switch 31 is in progress. If Step S301 is YES, the process goes to Step S308. Step S308 stores the fuel pressure sensed by the fuel pressure sensor 29 before the initial discharge stroke of the high-pressure pump 14 in a memory such as RAM of the ECU 30 as base fuel pressure P0. Then, the routine is ended.

If the initialization processing is ended, the process goes to Step S302. Step S302 determines whether the calculation of the fuel pressure increase ΔPr is completed. If Step S302 is YES, the process goes to Step S309. Step S309 stores the already calculated fuel pressure increase ΔPr as a renewed learning value in a rewritable nonvolatile memory such as backup RAM of the ECU 30. Then, the routine is ended.

If Step S302 is NO, the process goes to Step S303. Step S303 determines whether energization (discharge) of the high-pressure pump 14 is first energization (first discharge). If Step S303 is NO, i.e., if the energization (discharge) is second or following energization (second or following discharge), the process goes to Step S309. Step S309 learns the already estimated fuel pressure increase ΔPr. Then, the routine is ended.

If Step S303 is YES, the process goes to Step S304. Step S304 determines whether the energization flag is reset to OFF (whether the first discharge is ended). If Step S304 is NO (energization flag is ON or the fuel discharge is in progress), the process goes to Step S309, where the already estimated fuel pressure increase ΔPr is learned. Then, the routine is ended.

Thereafter, when the energization flag is reset to OFF (when the first discharge is ended), Step S304 becomes YES, and the process goes to Step S305. Step S305 reads in the fuel pressure Pr sensed by the fuel pressure sensor 29 at the moment (at the end of the first discharge). Then, Step S306 calculates the fuel pressure difference (Pr−PO) between the sensed fuel pressure Pr at the moment (end of the first discharge) and the base fuel pressure PO as the fuel pressure increase ΔPr from the injection setting to the injection start (ΔPr=Pr−PO).

In the first discharge stroke, the fuel pressure in the high-pressure fuel pipe 26 including the delivery pipe 27 is low and the change of the fuel temperature in the high-pressure fuel pipe 26 (exchange with the low-temperature fuel in the fuel tank 11) is small. Accordingly, the variation in the fuel pressure increase ΔPr due to the first discharge is small. Therefore, the fuel pressure increase ΔPr is calculated from the fuel pressure difference (Pr−PO) across the first discharge stroke as shown in FIG. 10. The present invention does not exclude calculating the fuel pressure difference ΔPr across the second or following discharge stroke of the high-pressure pump 14.

Then, the process goes to Step S307, where information about calculation completion of the fuel pressure increase ΔPr is stored. Thus, the routine is ended.

Figure 9:
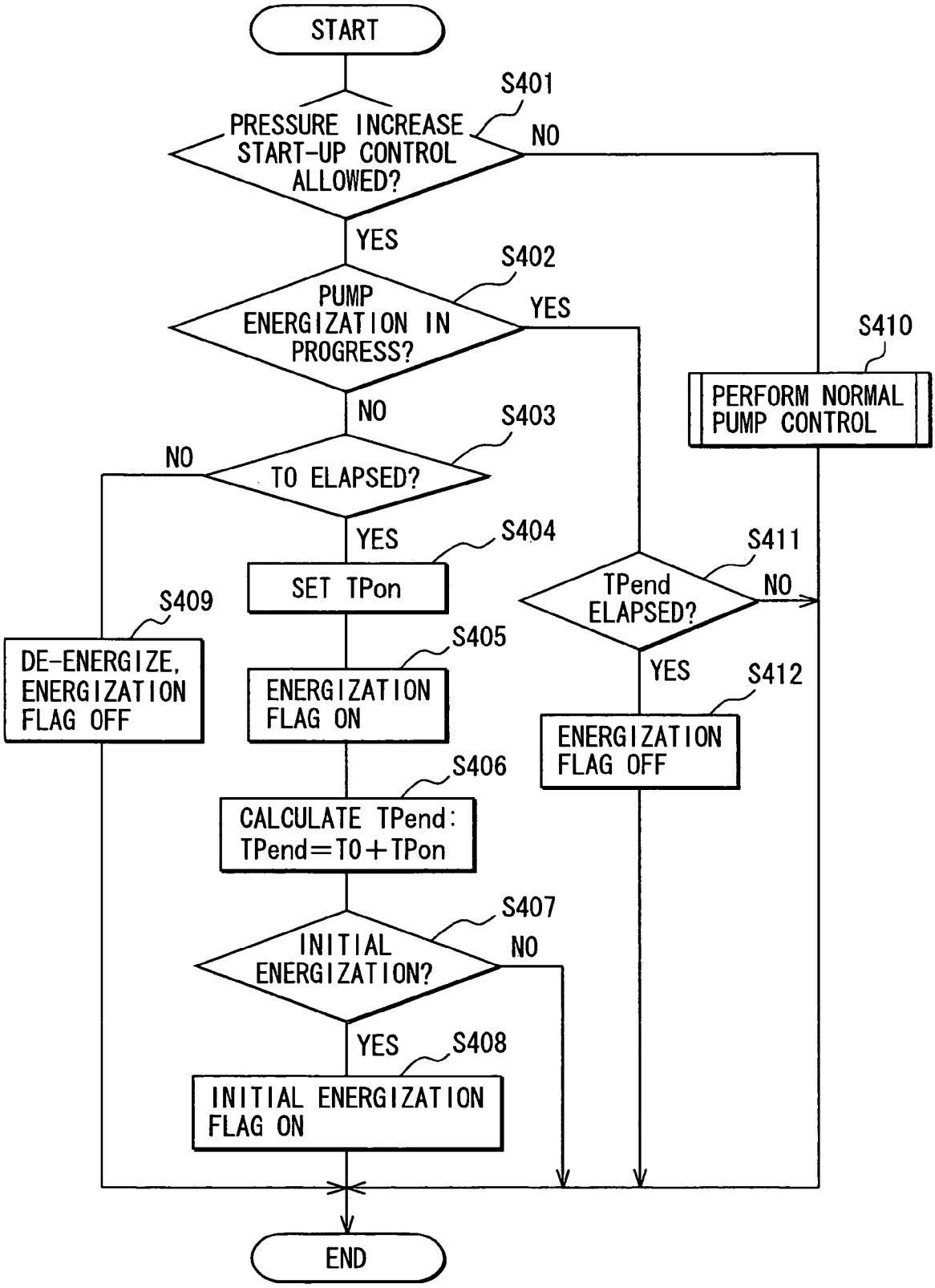
FIG. 9 is a flowchart showing a start-up time high-pressure pump control routine according to the FIG. 1 embodiment.

A start-up time high-pressure pump control routine shown in FIG. 9 is executed in a predetermined cycle (for example, a cycle of 8 ms) while the ignition switch 31 is ON. If this routine is started, first, Step S401 determines whether pressure increase start-up control is allowed. The pressure increase start-up control expedites the fuel pressure increase by prohibiting the injection when the fuel pressure Pr sensed by the fuel pressure sensor 29 is equal to or lower than a predetermined value during the start-up. If Step S401 is NO, the process goes to Step S410, where a normal high-pressure pump control routine (not shown) is executed to perform normal control of the high-pressure pump 14.

If Step S401 is YES, the process goes to Step S402, where it is determined whether the energization (discharge) of the high-pressure pump 14 is in progress. If Step S402 is NO, the process goes to Step S403, where it is determined whether an energization start period (period or crank angle from the injection setting to the energization start) T0 has elapsed. If Step S403 is NO, the process goes to Step S409. Step S409 holds the energization flag at OFF to hold the high-pressure pump 14 at a de-energized state (state in which the fuel is not discharged).

Thereafter, when the energization start period T0 elapses, the process goes to Step S404. Step S404 sets a predetermined energization period TPon that determines the discharge period (valve closing period of the fuel pressure control valve 22) of the pressure increase start-up control. Then, Step S405 turns on the energization flag. Then, the process goes to Step S406. Step S406 adds the energization period TPon to the energization start period T0 to obtain an energization end period TPend (period or crank angle from the injection setting to the energization end) (TPend=T0+TPon).

Then, the process goes to Step S407, where it is determined whether the energization (discharge) of the high-pressure pump 14 is the initial energization (initial discharge). If Step S407 is YES, the process goes to Step S408. Step S408 turns on an initial energization flag to allow the initial energization. If Step S407 is NO, i.e., if the energization (discharge) is the second or following energization (discharge), the routine is ended without change.

If Step S402 is YES, the process goes to Step S411, where it is determined whether the energization end period TPend has elapsed. If Step S411 is NO, the energization of the high-pressure pump 14 is continued without change. When the energization end period TPend elapses, the process goes to Step S412, where the energization flag is turned off to end the energization of the high-pressure pump 14 and to open the fuel pressure control valve 22. Thus, the discharge from the high-pressure pump 14 is ended.

In the present embodiment, the injection control system calculates the final injection period by correcting the basic injection period (basic injection amount) with the fuel pressure correction coefficient KP corresponding to the fuel pressure at the injection setting time (injection period calculation time). The injection control system estimates the fuel pressure PRest of the injection start time at the injection setting time (injection period calculation time) and calculates the fuel pressure correction coefficient KP based on the estimated fuel pressure PRest. Therefore, even if the actual fuel pressure fluctuates due to the fuel discharge of the high-pressure pump 14 before the injection start time, the fuel pressure correction coefficient considering the fluctuation of the actual fuel pressure can be set. Thus, the fuel pressure correction of the injection period (injection amount) can be performed accurately. A sign ΔQ in FIGS. 10 and 11 represents a decrease in the injection amount due to the fuel pressure correction.

If there is no fuel discharge from the high-pressure pump 14 in the injection waiting period from the injection period calculation time (injection setting time) to the injection start time, the actual fuel pressure does not fluctuate during the injection waiting period and the actual fuel pressure of the injection start time coincides with the actual fuel pressure of the injection setting time. Therefore, in the present embodiment, it is determined whether the high-pressure pump 14 discharges the fuel before the injection start. If the high-pressure pump 14 does not discharge the fuel by the injection start, the fuel pressure Pr sensed by the fuel pressure sensor 29 at the injection period calculation time (injection setting time) itself is regarded as the fuel pressure of the injection start time. Thus, the fuel pressure of the injection start time can be estimated accurately with a suitable method in accordance with existence or nonexistence of the fuel discharge from the high-pressure pump 14 in the injection waiting period.

In the above embodiment, if the high-pressure pump 14 discharges the fuel in the injection waiting period from the injection period calculation time (injection setting time) to the injection start time during the engine operation, the fuel pressure PRest of the injection start time is estimated every time. However, in the operation range in which the actual fuel pressure is stabilized, the fuel pressure difference between the injection setting time and the injection start time is small. Therefore, the estimated fuel pressure correction may not be necessarily performed in such an operation range.

Figure 15:
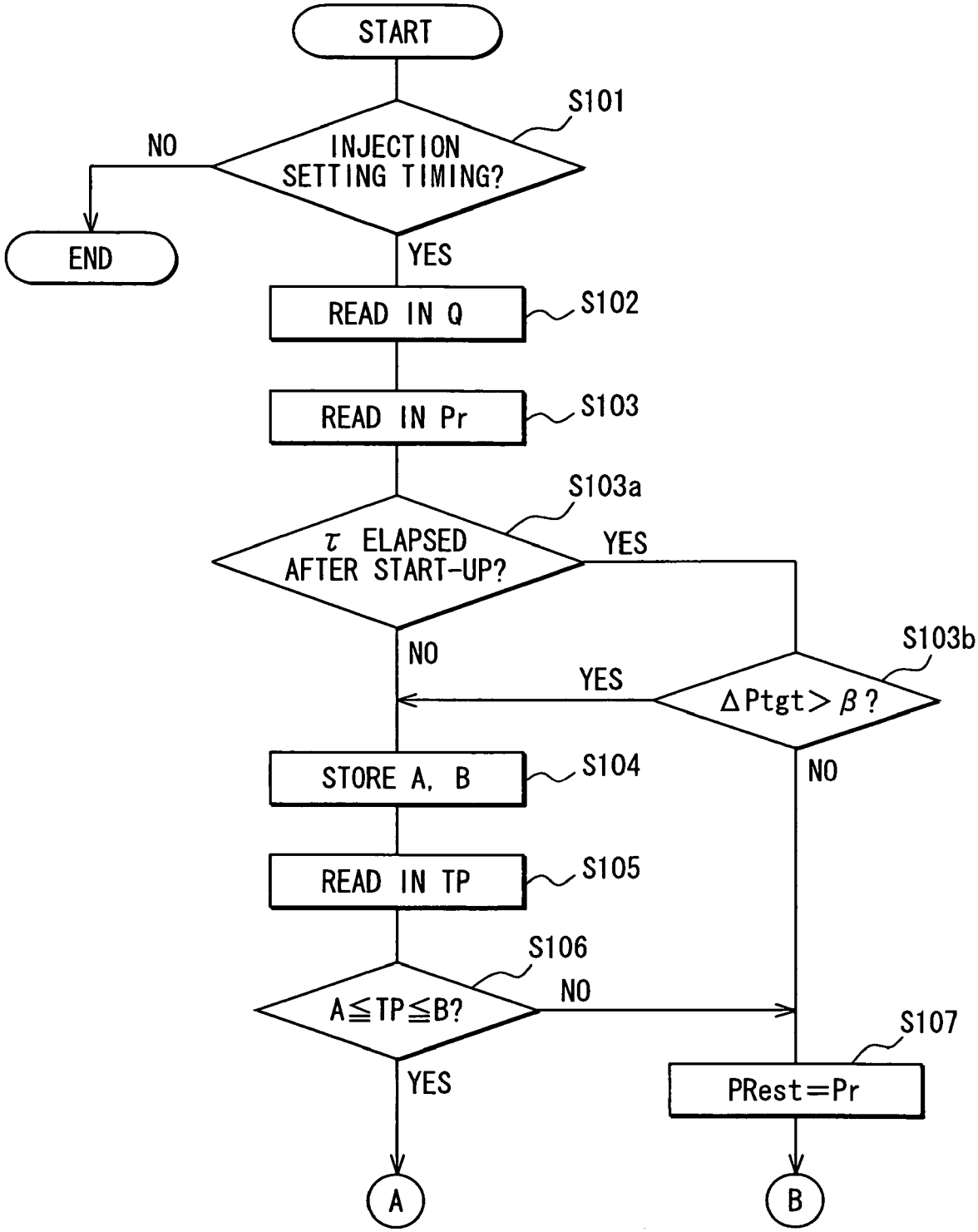
FIG. 15 is a flowchart showing a part of an injection period calculation routine according to a second example embodiment of the present invention.

In consideration of this point, a control method according to a second example embodiment of the present invention shown in FIG. 15 performs estimated fuel pressure correction when the target fuel pressure changes from a start-up by a predetermined value or more.

In an injection period calculation routine of the second example embodiment shown in FIG. 15, two determination steps of Step S103*a* and Step S103*b* are added after Step S103 of the injection period calculation routine shown in FIG. 4. The other processing is the same as the processing shown in FIG. 4.

In the injection period calculation routine shown in FIG. 15, the basic injection amount Q and the fuel pressure Pr sensed by the fuel pressure sensor 29 are read in for each injection setting timing (Step S101 to Step S103), and then, the process goes to Step S103*a*. Step S103*a* determines whether a predetermined time τ has elapsed after the start-up, i.e., whether the fuel pressure Pr is increased to the target fuel pressure Ptgt and stabilized. If Step S103*a* is NO, the processing from Step S104 is performed to estimate the fuel pressure PRest of the injection start time through a method similar to that of the first example embodiment.

If Step S103*a* is YES, the process goes to Step S103*b*, where it is determined whether a target fuel pressure change ΔPtgt from the previous injection setting to the present injection setting is greater than a predetermined value β. If Step S103*b* is YES, the processing from Step S104 is performed to estimate the fuel pressure PRest of the injection start time through a method similar to that of the first example embodiment.

If Step S103*b* is NO, it is determined that the fuel pressure fluctuation before the injection start is small, and the sensed fuel pressure Pr of the injection setting time is set as the estimated fuel pressure PRest of the injection start time without change. The other processing is the same as the processing of the first example embodiment.

As explained above, the second example embodiment performs the estimated fuel pressure correction when the engine is started and when the target fuel pressure changes by a predetermined value or more. Thus, the estimated fuel pressure correction can be performed in a limited operation area in which the fuel pressure difference between the injection setting time and the injection start time is large. Accordingly, a calculation load of the ECU 30 can be decreased.

The estimated fuel pressure correction may be performed when the engine is started or when the target fuel pressure changes by a predetermined value or more.

The present invention should not be limited to the disclosed embodiments, but may be implemented in many other ways without departing from the spirit of the invention.

What is claimed is:

1. A controller for an in-cylinder injection internal combustion engine, which pressurizes fuel to high pressure and supplies the fuel to a fuel injection valve with a high-pressure pump, the fuel injection valve injecting the fuel directly into a cylinder of the engine, the controller comprising:

a fuel pressure sensor that senses pressure of the fuel supplied to the fuel injection valve;

a fuel pressure controlling device that controls a discharge amount of the high-pressure pump to conform the fuel pressure sensed by the fuel pressure sensor to target fuel pressure;

a fuel pressure correcting device that calculates a final injection period by correcting a basic injection period corresponding to an operating state of the engine with a fuel pressure correction coefficient corresponding to the fuel pressure at predetermined timing before an injection start;

an injection setting device that sets injection start timing and the injection period at the predetermined timing before the injection start; and an injection controlling device that performs injection by driving the fuel injection valve at the injection start timing for the injection period set by the injection setting device;

wherein:

the fuel pressure correcting device performs estimated fuel pressure correction for estimating the fuel pressure to occur at the injection start and for setting the fuel pressure correction coefficient based on the estimated fuel pressure;

the fuel pressure correcting device selectively performs the estimated fuel pressure correction when the fuel discharge of the high-pressure pump occurs before the injection start, and the fuel pressure correcting device selectively sets the fuel pressure correction coefficient based on the fuel pressure sensed by the fuel pressure sensor without performing the estimated fuel pressure correction when the fuel discharge from the high-pressure pump does not occur before the injection start.

2. A controller for an in-cylinder injection internal combustion engine, which pressurizes fuel to high pressure and supplies the fuel to a fuel injection valve with a high-pressure pump, the fuel injection valve injecting the fuel directly into a cylinder of the engine, the controller comprising:

a fuel pressure sensor that senses pressure of the fuel supplied to the fuel injection valve;

a fuel pressure controlling device that controls a discharge amount of the high-pressure pump to conform the fuel pressure sensed by the fuel pressure sensor to target fuel pressure;

a fuel pressure correcting device that calculates a final injection period by correcting a basic injection period corresponding to an operating state of the engine with a fuel pressure correction coefficient corresponding to the fuel pressure at predetermined timing before an injection start;

an injection setting device that sets injection start timing and the injection period at the predetermined timing before the injection start; and an injection controlling device that performs injection by driving the fuel injection valve at the injection start timing for the injection period set by the injection setting device;

wherein:

the fuel pressure correcting device performs estimated fuel pressure correction for estimating the fuel pressure to occur at the injection start and for setting the fuel pressure correction coefficient based on the estimated fuel pressure;

the fuel pressure correcting device, when the fuel pressure correcting device estimates the fuel pressure to occur at the injection start, uses the target fuel pressure as the estimated fuel pressure if a difference between the target fuel pressure and the sensed fuel pressure is a fuel pressure difference that can be achieved by the fuel discharge of the high-pressure pump before the injection start.

3. A controller for an in-cylinder injection internal combustion engine, which pressurizes fuel to high pressure and supplies the fuel to a fuel injection valve with a high-pressure pump, the fuel injection valve injecting the fuel directly into a cylinder of the engine, the controller comprising:

a fuel pressure sensor that senses pressure of the fuel supplied to the fuel injection valve;

a fuel pressure controlling device that controls a discharge amount of the high-pressure pump to conform the fuel pressure sensed by the fuel pressure sensor to target fuel pressure;

a fuel pressure correcting device that calculates a final injection period by correcting a basic injection period corresponding to an operating state of the engine with a fuel pressure correction coefficient corresponding to the fuel pressure at predetermined timing before an injection start;

an injection setting device that sets injection start timing and the injection period at the predetermined timing before the injection start; and an injection controlling device that performs injection by driving the fuel injection valve at the injection start timing for the injection period set by the injection setting device;

wherein:

the fuel pressure correcting device performs estimated fuel pressure correction for estimating the fuel pressure to occur at the injection start and for setting the fuel pressure correction coefficient based on the estimated fuel pressure;

the fuel pressure correcting device, when the fuel pressure correcting device estimates the fuel pressure to occur at the injection start, calculates a fuel pressure increase to occur before the injection start based on at least one of fuel discharge performance of the high-pressure pump, fuel temperature and the sensed fuel pressure and calculates the estimated fuel pressure by adding the fuel pressure increase to the present sensed fuel pressure.

4. A controller for an in-cylinder injection internal combustion engine, which pressurizes fuel to high pressure and supplies the fuel to a fuel injection valve with a high-pressure pump, the fuel injection valve injecting the fuel directly into a cylinder of the engine, the controller comprising:

a fuel pressure sensor that senses pressure of the fuel supplied to the fuel injection valve;

a fuel pressure controlling device that controls a discharge amount of the high-pressure pump to conform the fuel pressure sensed by the fuel pressure sensor to target fuel pressure;

a fuel pressure correcting device that calculates a final injection period by correcting a basic injection period corresponding to an operating state of the engine with a fuel pressure correction coefficient corresponding to the fuel pressure at predetermined timing before an injection start;

an injection setting device that sets injection start timing and the injection period at the predetermined timing before the injection start; and an injection controlling device that performs injection by driving the fuel injection valve at the injection start timing for the injection period set by the injection setting device;

wherein:

the fuel pressure correcting device performs estimated fuel pressure correction for estimating the fuel pressure to occur at the injection start and for setting the fuel pressure correction coefficient based on the estimated fuel pressure;

the fuel pressure correcting device, when the fuel pressure correcting device estimates the fuel pressure to occur at the injection start, estimates a fuel pressure increase to occur before the injection start based on a fuel pressure difference across a discharge stroke of the high-pressure pump sensed by the fuel pressure sensor and calculates the estimated fuel pressure by adding the fuel pressure increase to the present sensed fuel pressure.

5. The controller as in claim 4, wherein the fuel pressure correcting device estimates the fuel pressure increase by correcting the fuel pressure difference across the discharge stroke of the high-pressure pump with the present sensed fuel pressure and/or fuel temperature.

6. A controller for an in-cylinder injection internal combustion engine, which pressurizes fuel to high pressure and supplies the fuel to a fuel injection valve with a high-pressure pump, the fuel injection valve injecting the fuel directly into a cylinder of the engine, the controller comprising:

a fuel pressure sensor that senses pressure of the fuel supplied to the fuel injection valve;

a fuel pressure controlling device that controls a discharge amount of the high-pressure pump to conform the fuel pressure sensed by the fuel pressure sensor to target fuel pressure;

a fuel pressure correcting device that calculates a final injection period by correcting a basic injection period corresponding to an operating state of the engine with a fuel pressure correction coefficient corresponding to the fuel pressure at predetermined timing before an injection start;

an injection setting device that sets injection start timing and the injection period at the predetermined timing before the injection start; and an injection controlling device that performs injection by driving the fuel injection valve at the injection start timing for the injection period set by the injection setting device;

wherein:

the fuel pressure correcting device performs estimated fuel pressure correction for estimating the fuel pressure to occur at the injection start and for setting the fuel pressure correction coefficient based on the estimated fuel pressure;

the fuel pressure correcting device performs the estimated fuel pressure correction when the engine is started or when the target fuel pressure changes by a predetermined value or more.

7. A control method for an in-cylinder injection internal combustion engine, the control method comprising:

a pressure sensing step of sensing pressure of fuel supplied by a high-pressure pump to a fuel injection valve that injects the fuel directly into a cylinder of the engine;

a pressure controlling step of controlling a discharge amount of the high-pressure pump to conform the sensed fuel pressure to target fuel pressure;

a pressure correcting step of calculating a final injection period by correcting a basic injection period corresponding to an operating state of the engine with a fuel pressure correction coefficient corresponding to the fuel pressure at predetermined timing before an injection start;

an injection setting step of setting injection start timing and the injection period at the predetermined timing before the injection start; and an injection controlling step of performing injection by driving the fuel injection valve at the injection start timing for the injection period set at the injection setting step;

wherein:

the correcting step performs estimated fuel pressure correction for estimating the fuel pressure to occur at the injection start and for setting the fuel pressure correction coefficient based on the estimated fuel pressure; and the pressure correcting step selectively performs the estimated fuel pressure correction when the fuel discharge of the high-pressure pump occurs before the injection start, and the pressure correcting step selectively sets the fuel pressure correction coefficient based on the sensed fuel pressure without performing the estimated fuel pressure correction when the fuel discharge from the high-pressure pump does not occur before the injection start.

8. A control method for an in-cylinder injection internal combustion engine, the control method comprising:

a pressure sensing step of sensing pressure of fuel supplied by a high-pressure pump to a fuel injection valve that injects the fuel directly into a cylinder of the engine;

a pressure controlling step of controlling a discharge amount of the high-pressure pump to conform the sensed fuel pressure to target fuel pressure;

a pressure correcting step of calculating a final injection period by correcting a basic injection period corresponding to an operating state of the engine with a fuel pressure correction coefficient corresponding to the fuel pressure at predetermined timing before an injection start;

an injection setting step of setting injection start timing and the injection period at the predetermined timing before the injection start; and an injection controlling step of performing injection by driving the fuel injection valve at the injection start timing for the injection period set at the injection setting step;

wherein:

the correcting step performs estimated fuel pressure correction for estimating the fuel pressure to occur at the injection start and for setting the fuel pressure correction coefficient based on the estimated fuel pressure; and the pressure correcting step uses the target fuel pressure as the estimated fuel pressure if a difference between the target fuel pressure and the sensed fuel pressure is a fuel pressure difference that can be achieved by the fuel discharge of the high-pressure pump before the injection start.

9. A control method for an in-cylinder injection internal combustion engine, the control method comprising:

a pressure sensing step of sensing pressure of fuel supplied by a high-pressure pump to a fuel injection valve that injects the fuel directly into a cylinder of the engine;

a pressure controlling step of controlling a discharge amount of the high-pressure pump to conform the sensed fuel pressure to target fuel pressure;

a pressure correcting step of calculating a final injection period by correcting a basic injection period corresponding to an operating state of the engine with a fuel pressure correction coefficient corresponding to the fuel pressure at predetermined timing before an injection start;

an injection setting step of setting injection start timing and the injection period at the predetermined timing before the injection start; and an injection controlling step of performing injection by driving the fuel injection valve at the injection start timing for the injection period set at the injection setting step;

wherein:

the correcting step performs estimated fuel pressure correction for estimating the fuel pressure to occur at the injection start and for setting the fuel pressure correction coefficient based on the estimated fuel pressure; and the pressure correcting step calculates a fuel pressure increase to occur before the injection start based on at least one of fuel discharge performance of the high-pressure pump, fuel temperature and the sensed fuel pressure and calculates the estimated fuel pressure by adding the fuel pressure increase to the present sensed fuel pressure.

10. A control method for an in-cylinder injection internal combustion engine, the control method comprising:

a pressure sensing step of sensing pressure of fuel supplied by a high-pressure pump to a fuel injection valve that injects the fuel directly into a cylinder of the engine;

a pressure controlling step of controlling a discharge amount of the high-pressure pump to conform the sensed fuel pressure to target fuel pressure;

a pressure correcting step of calculating a final injection period by correcting a basic injection period corresponding to an operating state of the engine with a fuel pressure correction coefficient corresponding to the fuel pressure at predetermined timing before an injection start;

an injection setting step of setting injection start timing and the injection period at the predetermined timing before the injection start; and an injection controlling step of performing injection by driving the fuel injection valve at the injection start timing for the injection period set at the injection setting step;

wherein:

the correcting step performs estimated fuel pressure correction for estimating the fuel pressure to occur at the injection start and for setting the fuel pressure correction coefficient based on the estimated fuel pressure; and the pressure correcting step estimates a fuel pressure increase to occur before the injection start based on a fuel pressure difference across a discharge stroke of the high-pressure pump sensed at the pressure sensing step and calculates the estimated fuel pressure by adding the fuel pressure increase to the present sensed fuel pressure.

11. The control method as in claim 10, wherein the pressure correcting step estimates the fuel pressure increase by correcting the fuel pressure difference across the discharge stroke of the high-pressure pump with the present sensed fuel pressure and/or fuel temperature.

12. A control method for an in-cylinder injection internal combustion engine, the control method comprising:

a pressure sensing step of sensing pressure of fuel supplied by a high-pressure pump to a fuel injection valve that injects the fuel directly into a cylinder of the engine;

a pressure controlling step of controlling a discharge amount of the high-pressure pump to conform the sensed fuel pressure to target fuel pressure;

a pressure correcting step of calculating a final injection period by correcting a basic injection period corresponding to an operating state of the engine with a fuel pressure correction coefficient corresponding to the fuel pressure at predetermined timing before an injection start;

an injection setting step of setting injection start timing and the injection period at the predetermined timing before the injection start; and an injection controlling step of performing injection by driving the fuel injection valve at the injection start timing for the injection period set at the injection setting step;

wherein:

the correcting step performs estimated fuel pressure correction for estimating the fuel pressure to occur at the injection start and for setting the fuel pressure correction coefficient based on the estimated fuel pressure; and the pressure correcting step performs the estimated fuel pressure correction when the engine is started or when the target fuel pressure changes by a predetermined value or more.

* * * * *